United States Patent [19]

Plowman

[11] 4,452,487

[45] Jun. 5, 1984

[54] OPERATORY STOOL WITH ADJUSTABLE ARM

[75] Inventor: Richard E. Plowman, York, Pa.

[73] Assignee: Dentsply Research & Development Corp., Milford, Del.

[21] Appl. No.: 291,895

[22] Filed: Aug. 11, 1981

[51] Int. Cl.[3] ..... A47C 7/54

[52] U.S. Cl. ..... 297/411; 297/417

[58] Field of Search ..... 297/411, 417, 373; 248/418; 108/142

[56] References Cited

U.S. PATENT DOCUMENTS

| | | | |
|---|---|---|---|
| 617,324 | 1/1899 | Earl . | |
| 1,292,099 | 1/1919 | Seymour . | |
| 1,359,468 | 11/1920 | Schmidt . | |
| 1,398,883 | 11/1921 | Mottlau . | |
| 1,629,939 | 5/1927 | Turner . | |
| 1,666,392 | 4/1928 | Masury . | |
| 1,700,088 | 1/1929 | Smith et al. | 297/373 X |
| 1,788,317 | 1/1931 | Morier et al. . | |
| 2,039,149 | 4/1936 | Dodge . | |
| 2,269,918 | 1/1942 | Sill | 297/417 |
| 2,546,460 | 3/1951 | Leeds | 248/158 |
| 2,568,988 | 9/1951 | Childs | 297/349 |
| 2,570,747 | 10/1951 | Bailey | 108/142 X |
| 2,763,523 | 9/1956 | Martin et al. . | |
| 2,764,223 | 9/1956 | Mischke . | |
| 3,435,783 | 4/1969 | Killenborn . | |
| 3,599,924 | 8/1971 | Schmidgall . | |
| 3,829,159 | 8/1974 | Leffler | 297/417 |
| 3,870,271 | 3/1975 | Bowman . | |
| 3,950,027 | 4/1976 | Wilson | 108/142 X |
| 4,025,112 | 5/1977 | Hale | 297/411 |

*Primary Examiner*—Francis K. Zugel

*Attorney, Agent, or Firm*—C. Hercus Just

[57] ABSTRACT

An operatory stool has a seat supported upon a post-like member extending upward from a caster-supported base, the seat having a short post extending upward from an edge of the seat and supports a horizontal curved arm for rotation about the axis of the post. Interengageable position control members are mounted respectively on the arm and upper end of the post and are operable for separation by raising the arm a short distance to disengage them, then rotate the arm about the axis of the post, and then release the arm to re-establish engagement of the position control members which are maintained in engagement by a compression spring. A one-way clutch also is mounted between the arm and post to permit rotation of the arm a limited distance in one direction only to augment the pivotal movement of the arm permitted by disengagement of the position control members.

5 Claims, 5 Drawing Figures

OPERATORY STOOL WITH ADJUSTABLE ARM

BACKGROUND OF THE INVENTION

The present invention pertains particularly to an operatory stool, such as used in the medical profession, including dentistry, the stool having a curved arm supported on the upper end of an upstanding post adjacent one edge of the stool, the arm being connected to the upper end of the post by means which permits rotation of the arm a limited extent about the axis of the vertical post.

The prior art does not provide many illustrations of a stool having an arm adjustable about an axis of a post extending upward from one edge of the seat. One example of such an arm, however, is the subject matter of prior U.S. Pat. No. 4,025,112, to Hale, dated May 24, 1977, in which a laterally extending member which supports the arm is pivotally connected to a vertical member by means of a slightly conical plug, frictionally disposed within a cup-shaped element, whereby downward movement or pressure upon the plug causes sufficient friction to prevent or control the amount of pivotal movement of the arms.

Related art in the field of stools or chairs includes mechanism in which either a radially or diametrically disposed pin is selectively received in notches to control the position of the seat of a stool with respect to the supporting base and a compression spring normally secures the pin within a selected notch or, in some instances, the circular row of teeth on one member are engageable with a corresponding circular row of teeth on another member of the stool and base. However, when the seat is occupied, the position control members are disengaged and the seat may readily be rotated about a vertical axis with respect to the supporting base. Typical examples of prior patents of this type are found in the following prior U.S. Patents:

U.S. Pat. No. 617,324, Earl, Jr., Jan. 10, 1899
U.S. Pat. No. 1,666,392, Masury, Apr. 17, 1928
U.S. Pat. No. 2,764,223, Mischke, Sept. 25, 1956
U.S. Pat. No. 3,599,924, Schmidgall, Aug. 17, 1971
U.S. Pat. No. 3,870,271, Bowman, Mar. 11, 1975

It also is old to control the rotation of one member, such as a chair seat, with respect to a base by means of a retractable pin selectively positionable in a circular row of holes or recesses. Examples of such structures are found in prior U.S. Pat. Nos. 1,629,939 to Turner, issued May 24, 1927, and 2,763,523 to Martin et al, issued Sept. 18, 1956.

One additional structure which might be considered pertinent to the present invention is found in U.S. Pat. No. 3,435,783, to Kollenborn, issued Apr. 1, 1976, in which a table top is supported by the upper end of a post and a segmental gear is positionable selectively at various portions of a circular gear for purposes of controlling the angularity of the table top about a horizontal axis.

The present invention includes position control means for the arm of a stool, which includes coengageable members, which, at first glance, appear to be similar to those of certain of the aforementioned prior patents, but the coengagement is in an opposite direction in the invention from those shown in the prior art and explained in detail hereinafter.

SUMMARY OF THE INVENTION

It is among the principal objects of the present invention to provide an operatory stool, such as frequently used by dentists and assistants, and other medical professionals, while making examinations and performing normal operative precedures, the stool having a seat from which a short post extends upward from an edge thereof and supports a horizontal, curved arm for limited rotation about the axis of said post, the principal novel advantages of the invention being to provide interengageable position control members mounted respectively on the arm and upper end of said post and operable for separation by raising the arm a short distance to disengage the members from each other to permit rotation of the arm about said axis and then release the arm to re-establish engagement of the position control members and prevent such relative rotation between said arm and post.

It is another object of the invention to provide in the above-described stool and arm combination, a compression spring which supplements the operation of gravity to maintain the coengageable position control members in engagement with each other.

It is a still further object of the invention ancillary to the foregoing object to provide said position control members respectively in the form of a series of circumferentially-spaced diametrically extending recesses or grooves in the surface of one of said control members and the other control member comprising a diametrically extending pin or rod which is receivable in a selected diametrical groove as desired relative to positioning the arm with respect to the upper end of said post.

Still another object of the invention is to provide additionally a one-way clutch arrangement which augments the positioning affect of the position control members by permitting further rotation of the arm relative to the post in one direction only by simply engaging the arm and manually turning it with respect to the supporting post.

One further object of the invention is to enclose the position control members, including the additional one-way clutch structure when used, compactly within a cup-shaped enclosure connected to the lower surface of the arm and normally prevent access to the position control members and one-way clutch structure.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENT

Figure 2:
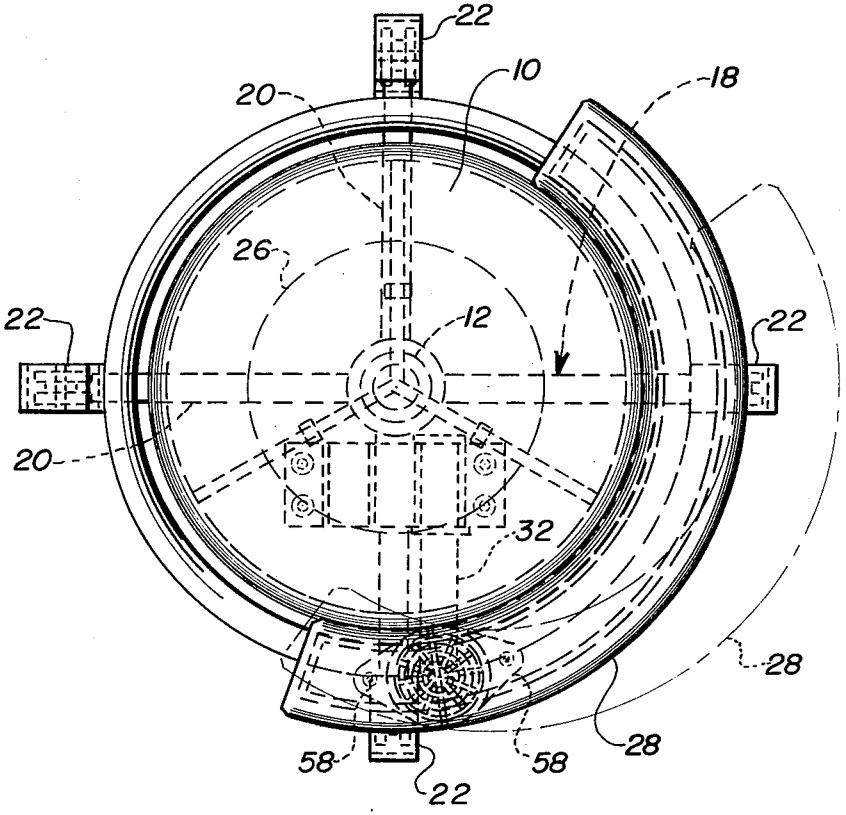
FIG. 2 is a top plan view of the stool shown in FIG. 1 and illustrating in full lines an initial position of the arm with respect to the seat and, in phantom, showing a selected different position to which the arm may be moved.
Figure 1:
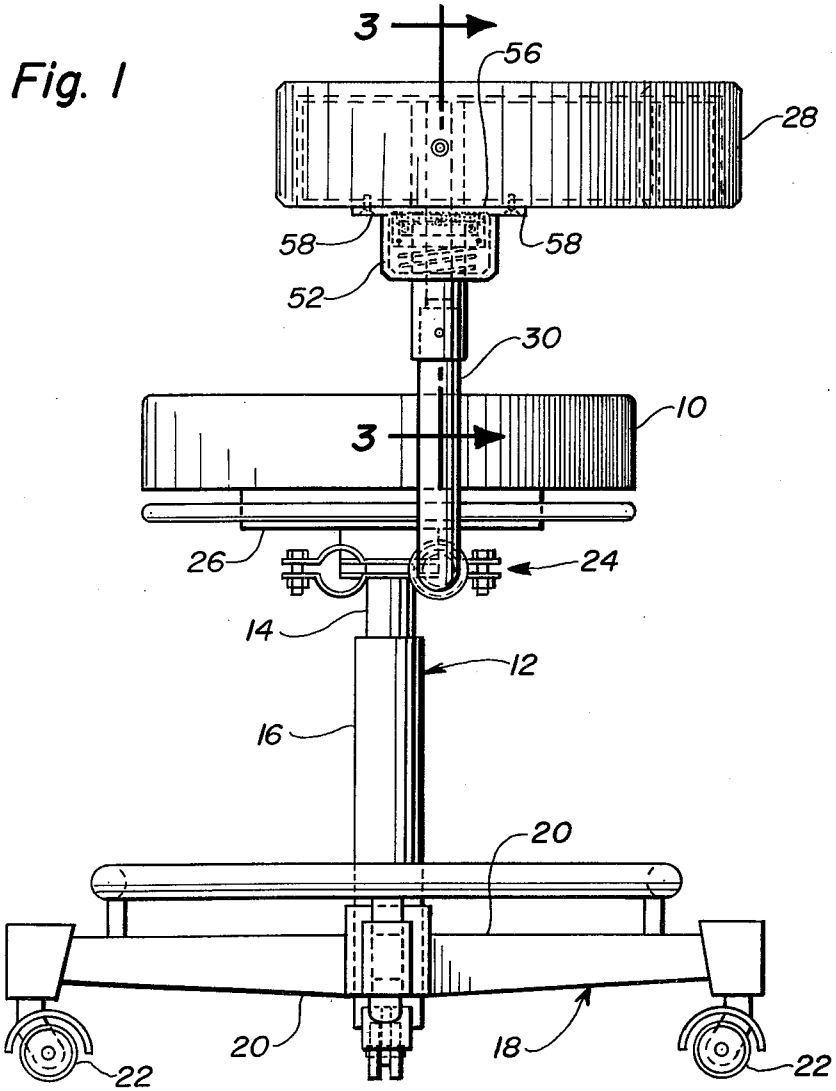
FIG. 1 is a side elevation of an exemplary stool embodying the principles of the present invention.

Referring to FIGS. 1 and 2, there is illustrated therein a popular type of operatory stool comprising a seat 10, which preferably is circular and upholstered. The seat is supported by a central post or column 12, which, as illustrated, is composed of a pair of telescoping members 14 and 16, capable of being vertically adjusted for different heights for the seat 10, and secured in an adjusted position by suitable conventional means, not illustrated. The lower end of the member 16 is connected centrally to a spider-like base 18, comprising a plurality of radially-extending arms 20, which on the outer ends thereof, support casters 22.

The upper end of the uppermost member 14 of the column 12 supports a clamping bracket assembly 24 upon which is mounted a head 26 to which the seat 10 is connected for support. The structure thus far recited is of conventional type embodied in prior patents, including U.S. Pat. No. 4,085,967, to Spencer, issued Apr. 25, 1978, and assigned to the assignee of the instant invention. The structure comprising the present invention primarily is for purposes of supporting a curved arm 28, which is similar to the arm shown in said aforementioned patent 4,085,967, but in the instant application, the arm is supported by different means and for a different purpose from the arm shown in said patent, details of which are as follows:

The clamping bracket assembly 24 is similar, for purposes of inventory, to the corresponding bracket shown in said aforementioned U.S. Pat. No. 4,085,967. However, only one of the openings in said assembly 24 is employed with the present invention to support vertically a post 30, which has on the lower end thereof a horizontal extension 32, shown in FIG. 2, selectively received in one of the openings in the bracket assembly 24, and preferably clamped thereby so that the post 30 is vertical and extends upward from an edge of the cushion 10.

The post 10 is fixedly connected to an upwardly extending tubular section 34, which, for practical purposes, can be considered part of the post 30. Reciprocally disposed within the upper portion of tubular section 34 is a post section 36.

Position and rotation control mechanism is provided between the arm 28 and the vertical post 30, 34 in the form of interengageable circular member 38, which preferably is in the form of an inverted cup, and a transverse pin member 40. In the preferred construction of the invention, the circular member 38 is fixed to and supported by the tubular section 34 on post 30 so as to be stationary relative thereto. Specifically, this is achieved by fixing a ring 42 to the outer surface of the tubular section 34 by any suitable means, the outer diameter of said ring being precisely equal to the inner diameter of the downward extending circular wall of the circular member 38, and fixed thereto by a pair of transverse rod-like keys 44, as clearly shown in FIGS. 3–5, said keys extending through complementary holes which are tangential to the outer surface of the ring 42.

Figure 4:
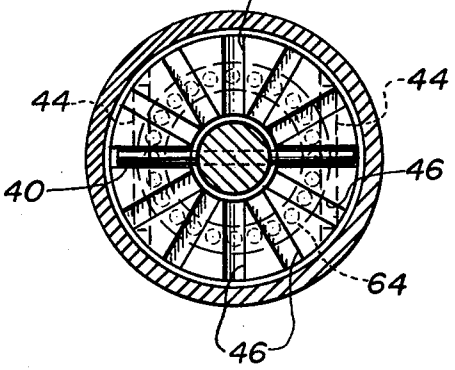
FIG. 4 is a transverse sectional view taken on the line 4—4 of FIG. 3.
Figure 3:
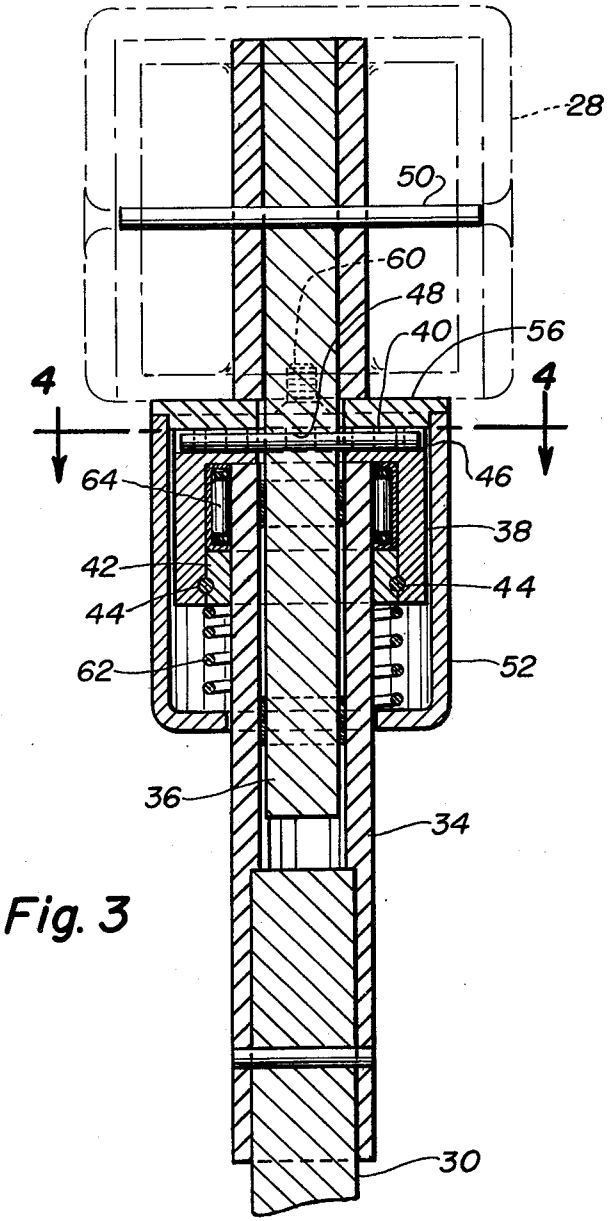
FIG. 3 is an enlarged, fragmentary vertical sectional view of the arm and supporting post, as seen on the line 3—3, of FIG. 1.

The upper end of the circular member 38, which is transverse to the axis of post section 36, is provided with a plurality of diametrical or radial recesses 46, which are arranged with equal angles therebetween, as clearly shown in FIG. 4. In cross-section, the recesses are illustrated, as seen in FIGS. 3 and 4, as being substantially square, but it will be understood that any suitable cross-sectional shape may be employed which is capable of receiving the transverse pin 40, which preferably is cylindrical. The transverse pin 40 extends through a transverse opening 48, formed in post section 36, intermediately between the ends thereof. Also, the post section 36 extends into and is connected fixedly to the arm 28 by means of transverse pin 50. Thus, it will be seen that pin member 40 is fixed to and moves with the arm 28.

The position and rotation control members comprising circular member 38 and pin member 40 are enclosed within a cup-shaped housing 52, the bottom of which has an opening 54 therein through which tubular section 34 extends. The upper open end of the cup-shaped member 52 is suitably connected to a horizontal plate 56, which has a pair of oppositely extending horizontal ears 58, which are secured by suitable screws 60, shown in FIGS. 3 and 5, to the lower surface of the curved arm 28.

Figure 5:
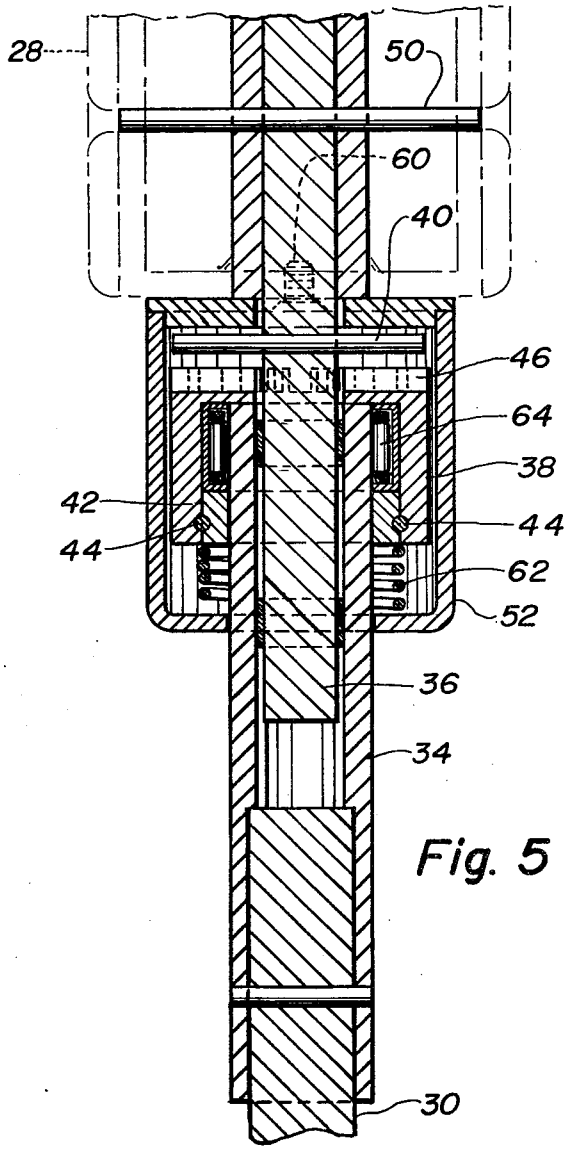
FIG. 5 is a fragmentary vertical sectional view, similar to FIG. 3, but showing the position control members in disengaged relationship to permit turning of the arm with respect to the supporting post.

Surrounding the portion of the tubular section 34, which is within the housing 52, between the bottom of said housing and the lower end of circular member 38 is a coiled compression spring 62, which is shown expanded in FIG. 3, in view of the pin member 40 being disposed within a selected diametrical recess 46. In FIG. 5, however, the spring 62 is compressed by reason of the arm 28 having been elevated a short distance sufficient to remove the pin member 40 from the diametrical recess 46 within which it was disposed, whereby the arm 28 may be pivotally moved about the axis of the post 30 and tubular section 34 to an adjusted position, one of which is shown in illustrative manner in phantom in FIG. 2. It will be understood that the arm 28 may be moved inwardly toward the axis of the post or column 12 or it may be moved away from the same, as indicated by the illustrative phantom position shown in FIG. 2. Following such adjustment of the arm 28 within a horizontal plane, said arm is then lowered by releasing the arm and permitting gravity, as well as the force of spring 62, to cause the pin 40 to be lowered into the nearest diametrical recess 46, and when said pin is received therein, further rotation of the arm with respect to post 30 normally is not possible, except for the operation of a one-way clutch 64, which is of a conventional off-the-shelf type comprising a plurality of needle-like bearing members engageable with tangential cam surfaces of known type to permit the arm 28 to be moved in one direction only about the axis of the post 30 and tubular section 34. As examples of the type of one-way clutch 64 to which applicant refers, the following prior U.S. Patents are referred to as illustrations of a range of such clutches:

U.S. Pat. No. 1,292,099—Seymour, Jan. 21, 1919—FIG. 3

U.S. Pat. No. 1,359,468—Schmidt, Nov. 16, 1920—FIG. 2

U.S. Pat. No. 1,398,883—Mottlau, Nov. 29, 1921—FIGS. 2–4

U.S. Pat. No. 1,788,317—Morier et al., Jan. 6, 1931—FIGS. 2–5

U.S. Pat. No. 2,039,149—Dodge, April 28, 1936—FIG. 1

Such additional adjustment of the position of the arm with respect to the seat 10 is desired under circumstances where a selected diametrical recess 46 does not locate the pin member 40 in a desired pivotally-adjusted position and further movement to a desired position is necessary, but it will be understood that such additional adjusted pivotal movement of the arm can only be accomplished in one direction, such as movement of the arm 28 inwardly toward the axis of the post or column 12.

In the normal use of a stool of the type illustrated which has a pivotally-connected arm 28 disposed above the seat of the stool, it is normal that the occupant of the stool may either have his back resting against the arm or his chest or midriff disposed against it, the latter position permitting a dentist, for example, to extend over a patient while being securely and comfortably supported by the curved arm 28 engaging his chest or midriff while the dentist has both hands free for operation upon the patient. Thus, by having the one-way clutch 64 operated in the manner described above, such type of leaning against the arm 28 may be undertaken safely without slipping, especially when the arm 28 is in its lowered position, such as illustrated in FIG. 3, and the position and rotating control members 38 and 40 are co-engaged. In the event a certain selected diametrical recess receives the pin member 40 but the user of the stool desires the arm to be moved outward from the axis of the post or column 12 a short additional distance, but not as much as to dispose the pin in the next succcessive recess 46, the pin may be disposed in such next successive recess to a more than desired outward position, but the occupant then may move the arm inwardly a desired amount by virtue of the function of the one-way clutch 64 and, when the ultimate desired position is reached, attempted outward movement of the arm by the occupant is prevented because of the unidirectional movement only that is afforded by the one-way clutch 64.

From the foregoing, it will be seen that an adjusted position established for the arm 28 with respect to the post 30 as described hereinabove is established simply by moving the arm upwardly a limited distance, rotating it, and then permitting the arm to descend by gravity and action of the compression spring 62 so as to re-engage the pin member 40 with one of the diametrical recesses 46 of the circular member 38, followed by further adjusting the position by the use of the one-way clutch 64 in the manner described above, if such additional adjustment is desired or necessary. Further, in view of the fact that the adjusted position is established when the arm is moved downwardly to coengage the position and rotation control members, such action is opposite to that disclosed in certain of the prior art patents referred to in the foregoing dissertation concerning the background of the invention, whereby such reverse operation by the present invention produces a desired and meritorious result not found in or capable of perfomance by such prior art devices.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An operatory stool comprising in combination, a seat, support means for said seat depending therefrom, a post extending upward from said seat adjacent an edge thereof, and a curved arm supported by the upper end of said post within a plane transverse to said post, the improvement comprising a post section reciprocably mounted upon the upper portion of said post for vertical movement in opposite directions and the upper end of said post section being connected to said arm to support it, coengageable rotation control members including a circular member coaxial with the axis of said post and provided with a series of radial recesses in the upper end thereof and a pin member extending transversely through said post section and positionable selectively in one or more of said recesses to prevent relative rotational movement between said circular member and post section about the axis of said circular member when said pin member and one of said recesses are coengaged, a cylindrical housing fixedly connected to the lower surface of said curved arm and enclosing said circular member and pin, and spring means within said housing and interengageable between said pin member and circular member and operable normally to urge said members into coengagement to prevent relative rotation between said post and arm, whereby when said arm is moved upward a predetermined distance said member with recesses and said pin member are disengaged to permit rotation of said arm about said post and upon release of said arm said spring means is operable to assist gravity in restoring said members into coengagement.

2. The stool according to claim 1 further characterized by said pin member comprising a pin extending transversely through said post section and said circular member has a horizontal upper surface provided with said radial recesses and said recesses comprising grooves complementary in cross-section to the pin membeer selectively to receive the same, and said spring means comprising a compression spring surrounding said post section and having opposite ends respectively acting between said circular member and said housing.

3. The stool according to claim 2 further including an intermediate tubular member receiving and fixed to the upper end of said post coaxially and the lower end of said post section being reciprocably received within said intermediate tubular member, means fixedly connecting said circular member of said rotation control members to the upper end of said intermediate tubular member and thereby fixedly attach the same to said post, said pin member being fixed to said post section intermediately of the ends thereof.

4. The stool according to claim 1 further including a one-way clutch mounted coaxially with said post and operable between said post and the circular member of said rotation control member to permit limited relative rotation between said arm and said post when moved in one direction and prevent relative rotation therebetween when rotatable movement between said post and arm is attempted.

5. The stool according to claim 4 further characterized by said circular member of said rotation control members comprising an inverted cup-shaped member with the closed end thereof being mounted uppermost and said radial recesses being formed in the upper surface thereof, said one-way clutch being mounted coaxially within said inverted cup-shaped member for enclosure therein.

* * * * *